US009139922B2

(12) United States Patent
Ringhand

(10) Patent No.: US 9,139,922 B2
(45) Date of Patent: Sep. 22, 2015

(54) CATHODE PLATE EDGE PROTECTOR AND METHODS OF MANUFACTURE

(71) Applicant: Clim-A-Tech Industries, Inc., Hopkins, MN (US)

(72) Inventor: Scott Ringhand, Eden Prairie, MN (US)

(73) Assignee: CLIM-A-TECH INDUSTRIES, INC., Hopkins, MN (US)

( * ) Notice: Subject to any disclaimer, the term of this patent is extended or adjusted under 35 U.S.C. 154(b) by 350 days.

(21) Appl. No.: 13/838,907

(22) Filed: Mar. 15, 2013

(65) Prior Publication Data

US 2014/0116876 A1 May 1, 2014

Related U.S. Application Data

(60) Provisional application No. 61/612,084, filed on Mar. 16, 2012.

(51) Int. Cl.
*C25C 7/00* (2006.01)
*C25C 7/02* (2006.01)

(52) U.S. Cl.
CPC .... *C25C 7/02* (2013.01); *C25C 7/00* (2013.01)

(58) Field of Classification Search
CPC ..... C25C 17/06; C25C 17/10–17/12; C25C 17/00–17/02
USPC ..... 204/281, 279, 297.01
See application file for complete search history.

(56) References Cited

U.S. PATENT DOCUMENTS

| | | | |
|---|---|---|---|
| 1,470,883 | A | 10/1923 | Schuh |
| 4,207,147 | A | 6/1980 | Babin |
| 4,406,769 | A | 9/1983 | Berger |
| 4,670,124 | A | 6/1987 | Bartsch et al. |
| 4,776,928 | A | 10/1988 | Perlich |
| 5,368,714 | A | 11/1994 | Tanaka et al. |
| 5,470,450 | A | 11/1995 | Tanaka et al. |
| 5,549,801 | A | 8/1996 | Perlich et al. |
| 5,690,798 | A | 11/1997 | Alexander et al. |
| 5,785,827 | A | 7/1998 | Dougherty |

(Continued)

FOREIGN PATENT DOCUMENTS

| | | | | |
|---|---|---|---|---|
| AU | WO9741280 A1 * | 10/1997 | ..... | C25D 7/02 |
| EP | 0202018 | 11/1986 | | |

(Continued)

OTHER PUBLICATIONS

Marley Plastics, "Cathode Edge-Strip System the market leader," Nov. 5, 2001, www.marley.com.au/products/mining.asp.

(Continued)

*Primary Examiner* — Luan Van

*Assistant Examiner* — Alexander W Keeling

(74) *Attorney, Agent, or Firm* — Gerald E. Helget; Briggs and Morgan, P.A.

(57) ABSTRACT

A method of manufacturing an edge protector for a cathode plate includes inserting a first retention plate into a slit in a first edge strip, proximate an end of the first edge strip. The first retention plate is also inserted into a slit in a second edge strip, proximate a first end of the second edge strip. Additionally, the first retention plate is inserted into a gap of a first plug, such that the first plug abuts both the end of the first edge strip and the first end of the second edge strip. A corner cap is then overmolded on the end of the first edge strip, the first plug, and the first end of the second edge strip.

11 Claims, 10 Drawing Sheets

(56) References Cited

U.S. PATENT DOCUMENTS

| | | | | |
|---|---|---|---|---|
| 5,928,482 | A | 7/1999 | Marttila | |
| 6,017,429 | A | 1/2000 | Persson | |
| 6,193,862 | B1 * | 2/2001 | Cutmore et al. | 204/281 |
| 6,231,730 | B1 | 5/2001 | Davis et al. | |
| 6,264,808 | B1 | 7/2001 | Marttila | |
| 6,274,012 | B1 | 8/2001 | Santoyo | |
| 6,312,573 | B1 | 11/2001 | Dwyer et al. | |
| 6,551,475 | B2 | 4/2003 | Dwyer | |
| 6,702,933 | B2 | 3/2004 | Alexander | |
| 6,746,581 | B2 | 6/2004 | Ebert | |
| 6,951,600 | B2 | 10/2005 | Santoyo | |

FOREIGN PATENT DOCUMENTS

| | | |
|---|---|---|
| JP | 63033590 | 2/1988 |
| WO | 9741280 | 11/1997 |

OTHER PUBLICATIONS

Wernick, "Devices for Controlling the Distribution of Electrodeposits," Electrodepositors' Technical Society, vol. XIX, 1943-44, pp. 35-48, Publication date is 1943-1944.

* cited by examiner

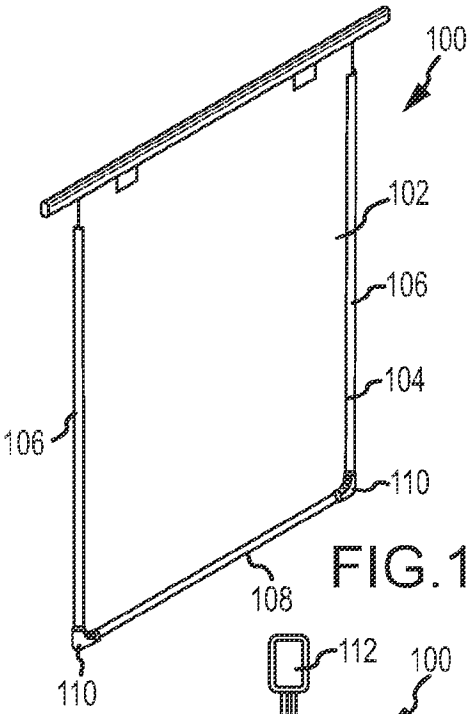
FIG. 1A
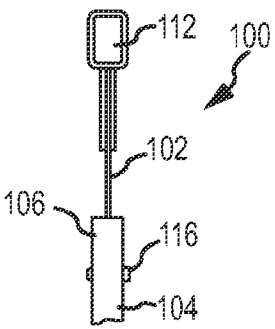
FIG. 1E
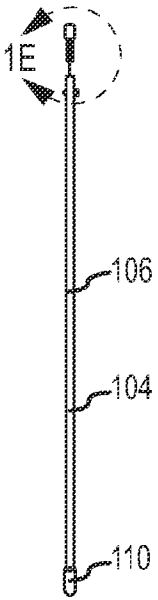
FIG. 1C
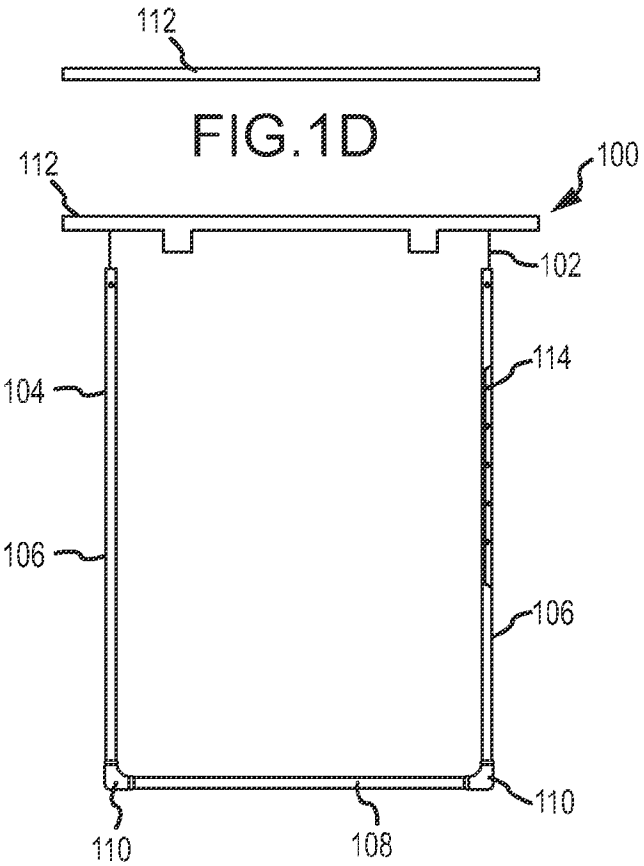
FIG. 1B
FIG. 1D

CATHODE PLATE EDGE PROTECTOR AND METHODS OF MANUFACTURE

CROSS-REFERENCE TO RELATED APPLICATIONS

This application claims priority to and the benefit of U.S. Provisional Patent Application Ser. No. 61/612,084, filed Mar. 16, 2012, entitled, "Cathode Plate Edge Protector and Methods of Manufacture," the disclosure of which is hereby incorporated by reference herein in its entirety.

INTRODUCTION

Cathode plates are used in electrowinning processes to remove heavy metals from concentrated solutions, for example, during certain processes for making copper sheets. A copper-bearing solution is mixed with an acid such as sulfuric acid, thus forming an electrolyte solution. This electrolyte solution is placed in a tank where alternating rows of stainless steel cathode plates and lead anode plates are suspended vertically. Electrical buss lines connected to the cathode and anode plates are connected to a DC source having a high current and a low voltage. This causes the copper in the solution to be deposited in layers on the cathode plates. Typically, copper deposits more heavily on the edges of the cathode plates, which can lead to problems moving the plates from the tanks, or removing the copper sheets from the steel plates after processing. For this reason, plastic (or otherwise non-conductive) edge protectors are placed on the edges of the cathode plates located below the surface of the solution. The edge protectors prevent excessive copper buildup at the plate edges. The technology associated with these edge protectors is constantly improving.

SUMMARY

In one aspect, the technology relates to a method of manufacturing an edge protector for a cathode plate, the method including: inserting a first retention plate into a slit in a first edge strip, proximate an end of the first edge strip; inserting the first retention plate into a slit in a second edge strip, proximate a first end of the second edge strip; inserting the first retention plate into a gap of a first plug, such that the first plug abuts both the end of the first edge strip and the first end of the second edge strip; and overmolding a first corner cap on the end of the first edge strip, the first plug, and the first end of the second edge strip.

In another aspect, the technology relates to an edge protector for a cathode plate, the edge protector including: a first edge strip having a beveled end and an elongate slit; a second edge strip having a beveled end and an elongate slit; and a first plug abutting both of the beveled end of the first edge strip and the beveled end of the second edge strip.

In another aspect, the technology relates to an edge protector for a cathode plate, the edge protector including: a first edge strip having a beveled end and an elongate slit; a second edge strip having a beveled end and an elongate slit; and a corner cap covering the beveled end of the first edge strip and the beveled end of the second edge strip, wherein the beveled end of the first strip and the beveled end of the second strip define a gap therebetween.

BRIEF DESCRIPTION OF THE DRAWINGS

There are shown in the drawings, embodiments which are presently preferred, it being understood, however, that the technology is not limited to the precise arrangements and instrumentalities shown.

FIGS. 1A-1D depict perspective, front, side, and top views, respectively, of a cathode plate having an edge protector.

FIG. 1E depicts an enlarged partial side view of the cathode plate of FIG. 1A.

DETAILED DESCRIPTION

Figure 1F:
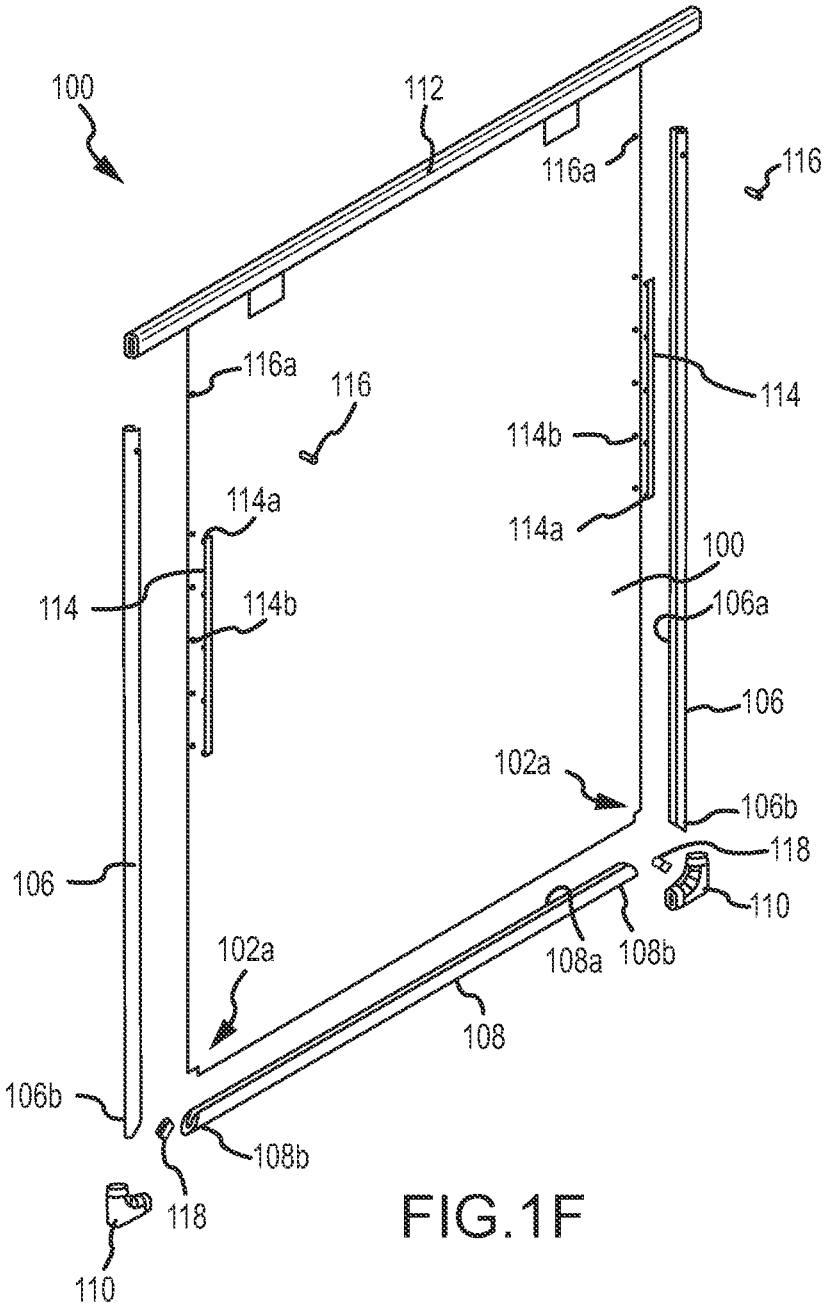
FIG. 1F depicts an exploded perspective view of the cathode plate of FIG. 1A.

Reference will now be made in detail to the exemplary aspects of the present disclosure that are illustrated in the accompanying drawings. Wherever possible, the same reference numbers will be used throughout the drawings to refer to the same or like structure.

FIGS. 1A-1F depict various views of a cathode plate system 100 having a steel plate 102 and an edge protector 104. The edge protector 104 includes two side edge strips 106 and a bottom edge strip 108. The side edge strips 106 and bottom edge strip 108 are joined at two overmolded corner caps 110. The edge strips 106, 108 and corner caps 110 are described in more detail below. The cathode plate 100 also includes a hanger 112 that is used to support the cathode plate 100 during transport and the electrowinning process. Buss lines (not shown) are connected as required to the hanger 112. Inserts 114 are located underneath the side edge strips 106 and hold the side edge strips 106 in place. Additionally, a top end of the side edge strips 106 may be held in place by one or more pins, screws, bolts, or other connectors 116.

FIG. 1F depicts an exploded view of the cathode plate 100, including additional elements not visible in the previous figures. For example, the pins 116 are passed through pin openings 116*a* in the steel plate 102. The inserts 114 also include a number of integral insert pins 114*a* that fit within insert pin openings 114*b* in the steel plate 102. Each of the side edge strips 106 and bottom edge strip 108 include an elongate slit 106*a*, 108*a*, respectively, that receive the corresponding edges of the steel plate 102. The bottom edge strip 108 includes two beveled ends 108*b*. Each of the two side edge strips 106 include a single beveled end 106*b*, proximate the beveled ends 108*b* of the bottom edge strip 108. A plug 118 is located between the beveled ends 106*b*, 108*b*, abutting both elements, as described in more detail below. While the ends 106*b*, 108*b* of the elements are depicted as beveled, in other embodiments, the ends may be cut perpendicular to the axis of each edge strip. The plug may be configured accordingly so as to accommodate this configuration and abut the square ends of the edge strips. Additionally, the bottom corners 102*a* of the steel plate 102 may be squared, chamfered, curved, or otherwise shaped to ease insertion of the finished edge protector 104 onto the steel plate 102.

Figure 2A:
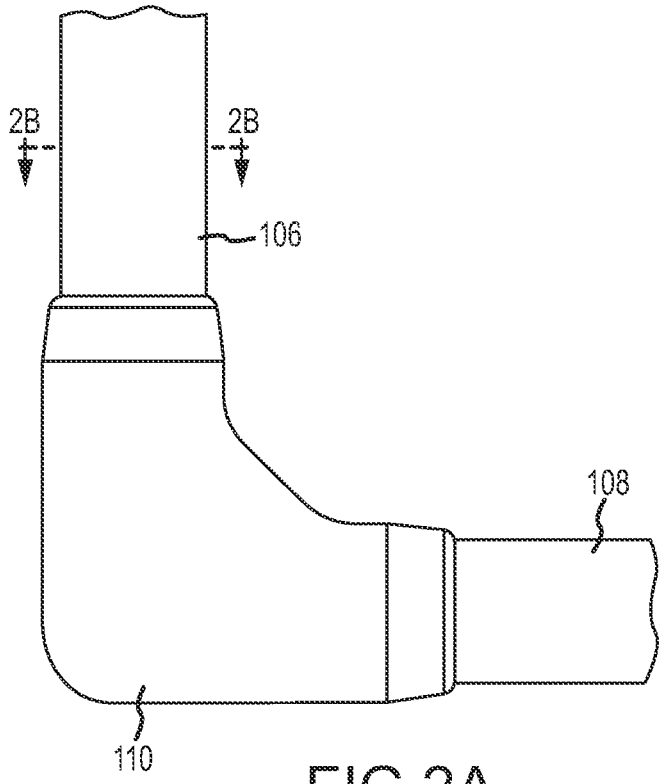
FIG. 2A is an enlarged view of a corner cap of a cathode plate edge protector.
Figure 2B:
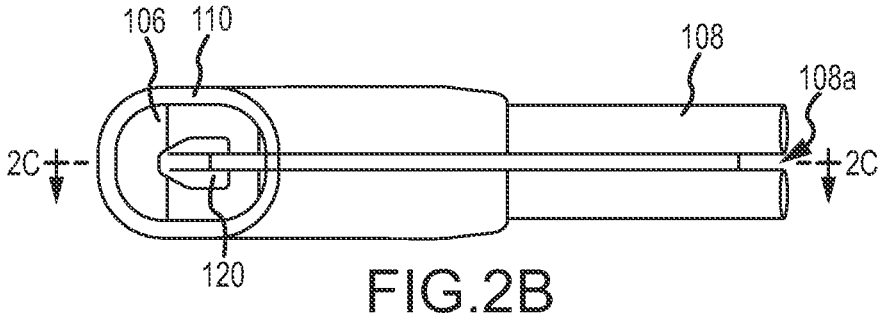
FIG. 2B is an enlarged end sectional view of the corner cap of FIG. 2A.
Figure 2C:
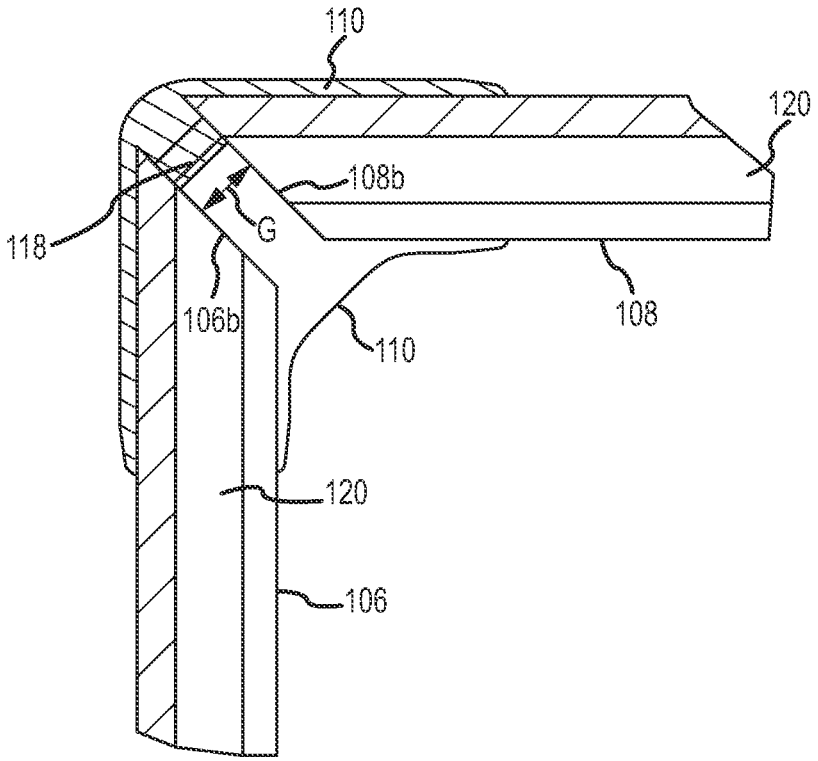
FIG. 2C an enlarged top sectional view of the corner cap of FIG. 2A.

FIGS. 2A-2C depict various enlarged views of the corner cap 110. The cap 110 is overmolded onto the beveled ends of the side edge strip 106 and bottom edge strip 108, as described in more detail below. In the depicted embodiment, the side edge strip 106 and bottom edge strip 108 each comprise substantially C-shaped elements. The open portion of the C-shape defines the elongate slit 106*a*, 108*a* of each strip. The side edge strip 106 (as well as the bottom edge strip 108) each define a void 120 that provides additional space around the edges of the plate 102. This void may be absent in other embodiments, and all interior surfaces of the edge strips 106, 108 may be tight to the steel plate 102 when installed. The edge strips, which may be extruded plastic profiles, may also take any other shapes, as required or desired. For example, round, square, or other profile shapes are contemplated, as required or desired for a particular application.

FIG. 2C is a top sectional view of the corner cap 110. As described herein, the cap 110 is overmolded onto the beveled ends 106*b*, 108*b* of the edge strips 106, 108. The plug 118 is located between the two beveled ends 106*b*, 108*b*, and abuts both elements. In that regard, the plug 118 defines a gap G between the beveled ends 106*b*, 108*b*, which do not touch each other. The overmolding may extend virtually any distance from the plug 118 along the strips 106, 108, although distances of about 2.75 inches (on strips having a length of about 42 inches to about 51 inches) may be desirable. In general, the overmolded cap 110 need only cover a sufficient portion of the beveled ends 106*b*, 108*b* so to form a robust connection.

Figure 3B:
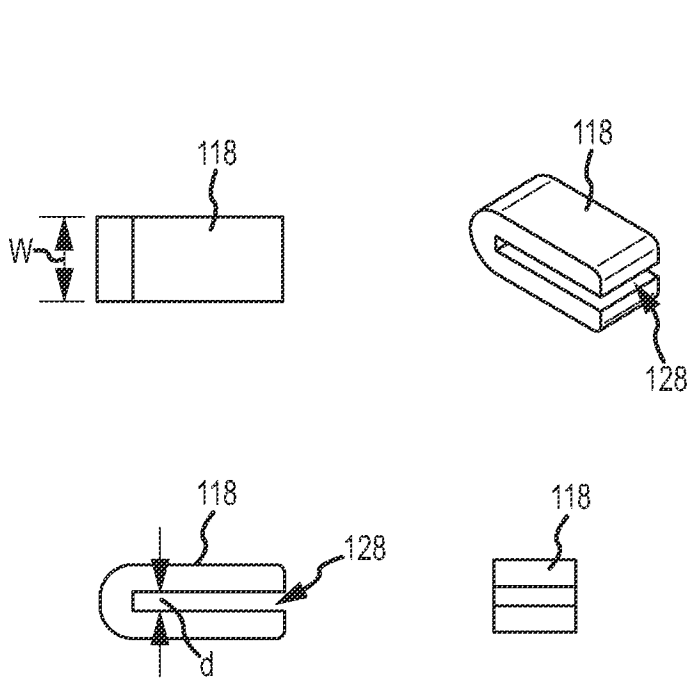
FIG. 3B depicts various views of a corner plug.
Figure 3A:
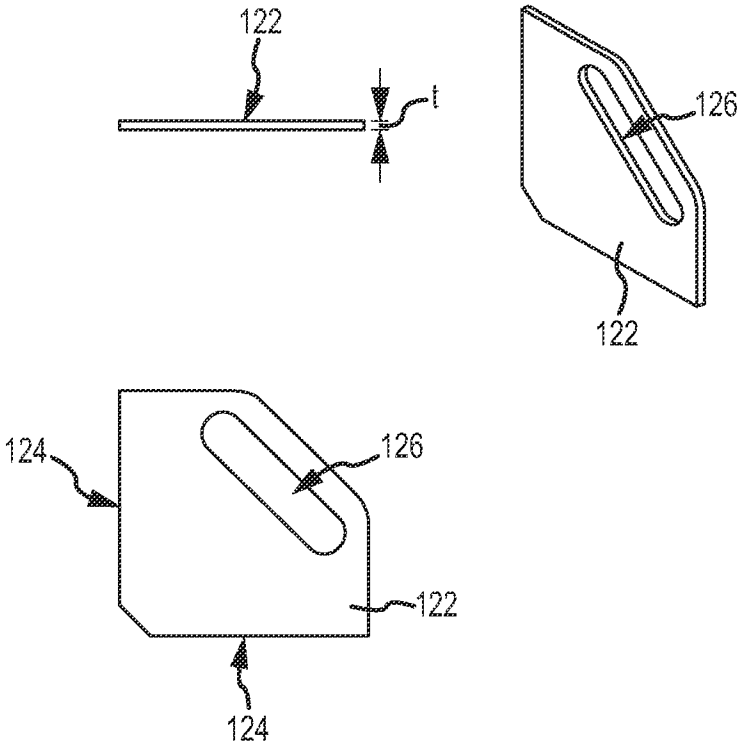
FIG. 3A depicts various views of a retention plate.

FIG. 3A depicts a molding retention plate 122, used in the manufacture of the edge protector 104 described herein, as well as to reinforce the overmolded corner cap 110. The molding retention plate 122 includes two substantially orthogonal rear edges 124 and is of a thickness t to fit within the elongate slits 106*a*, 108*a* within the side edge strip 106 and bottom edge strip 108. The rear edges 124 are substantially orthogonal to form a square joint for the edge strips 106, 108. The plate 122 may define an opening 126 or other element to aid in removing the plate 122 from the overmolded corner cap 110. FIG. 3B depicts various views of the plug 118. A width w of the plug 118 defines the gap G when the edge strips 106, 108 abut the plug 118. The plug 118 also defines a slot 128 for receiving the molding retention plate 122 during the overmolding process, described below. In general, the depth d of the slot 128 is a close fit with the thickness t of the molding retention plate 122, to ensure the connection is maintained during the manufacturing process. Also, the retention plate 122 helps ensure alignment of the elongate slits 106*a*, 108*a*, with the slot 128 of the plug 118. In certain embodiments, the retention plate and the plug may be manufactured as a unitary part, with the retention plate having an enlarged portion against which the beveled ends of the first and second edge strips abut during manufacture.

Figure 4:
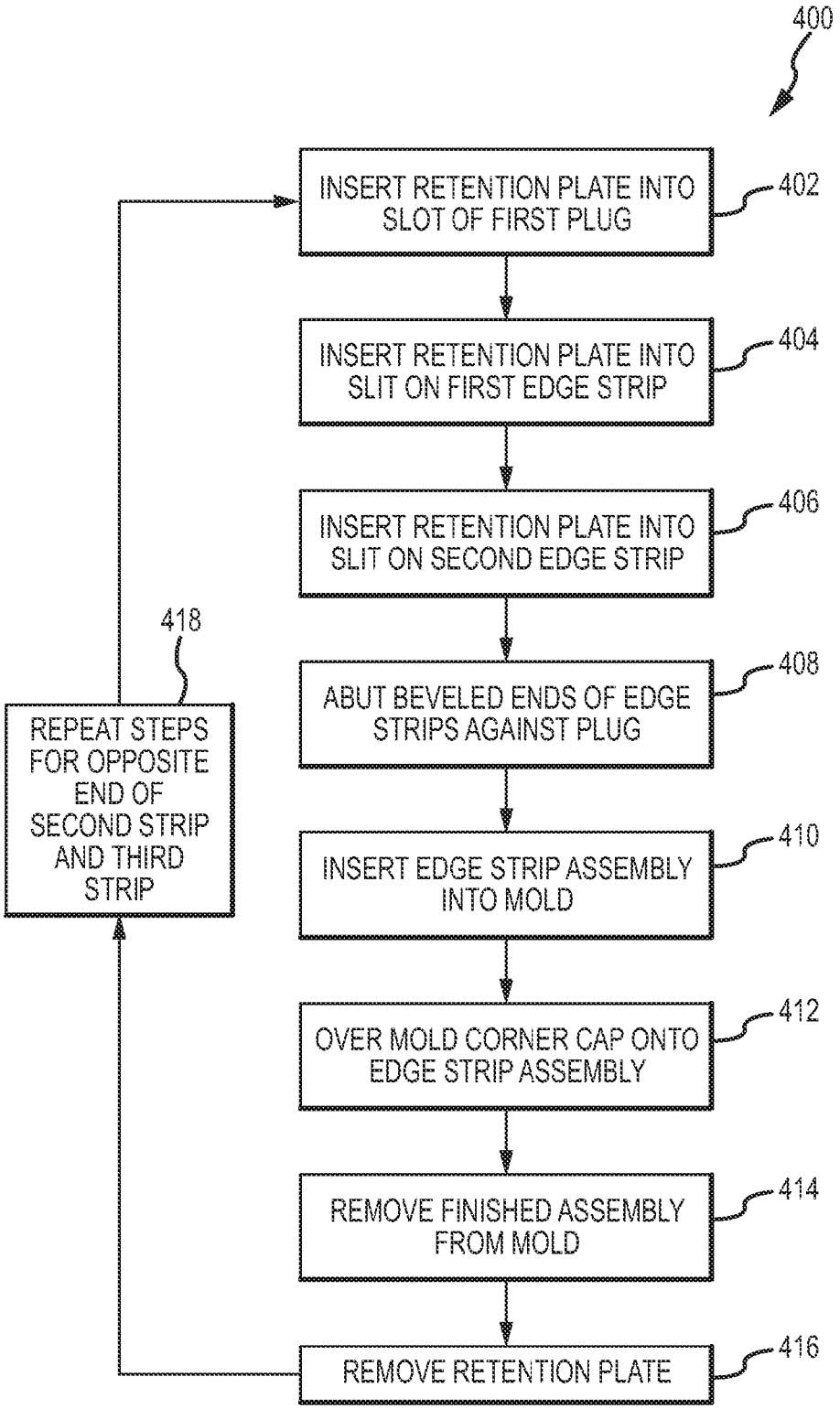
FIG. 4 depicts a method of manufacturing a cathode plate edge protector.
Figure 5A:
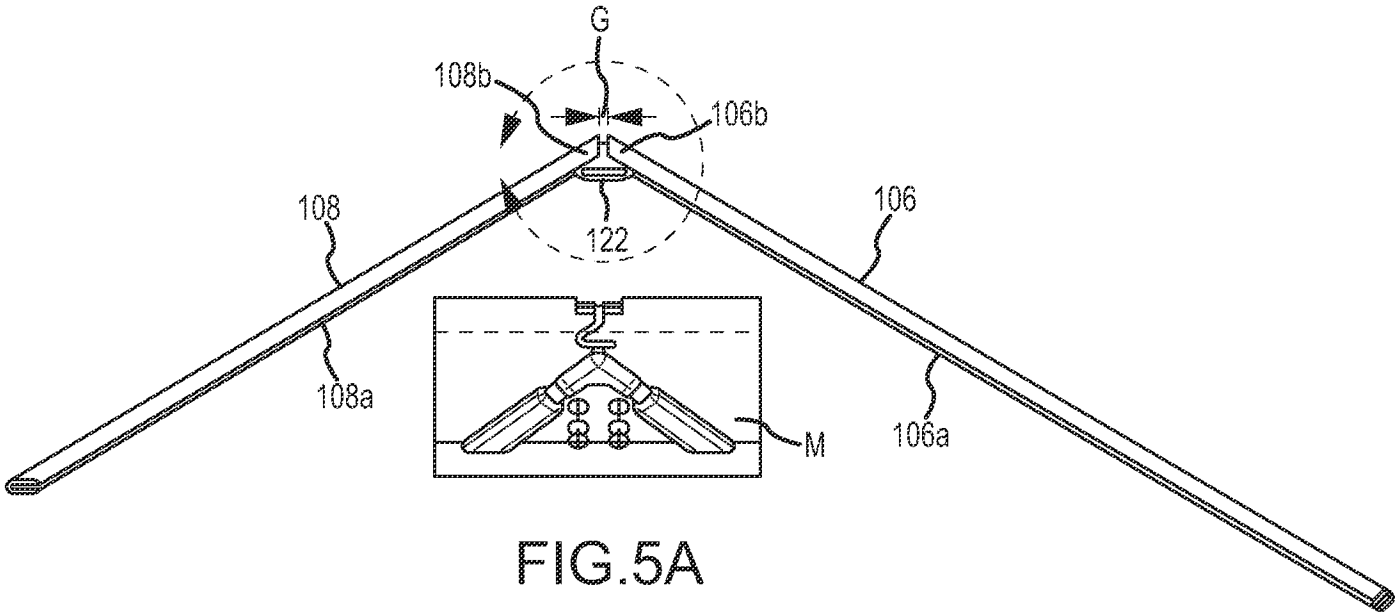
FIGS. 5A-5D depict the method of FIG. 4.
Figure 5B:
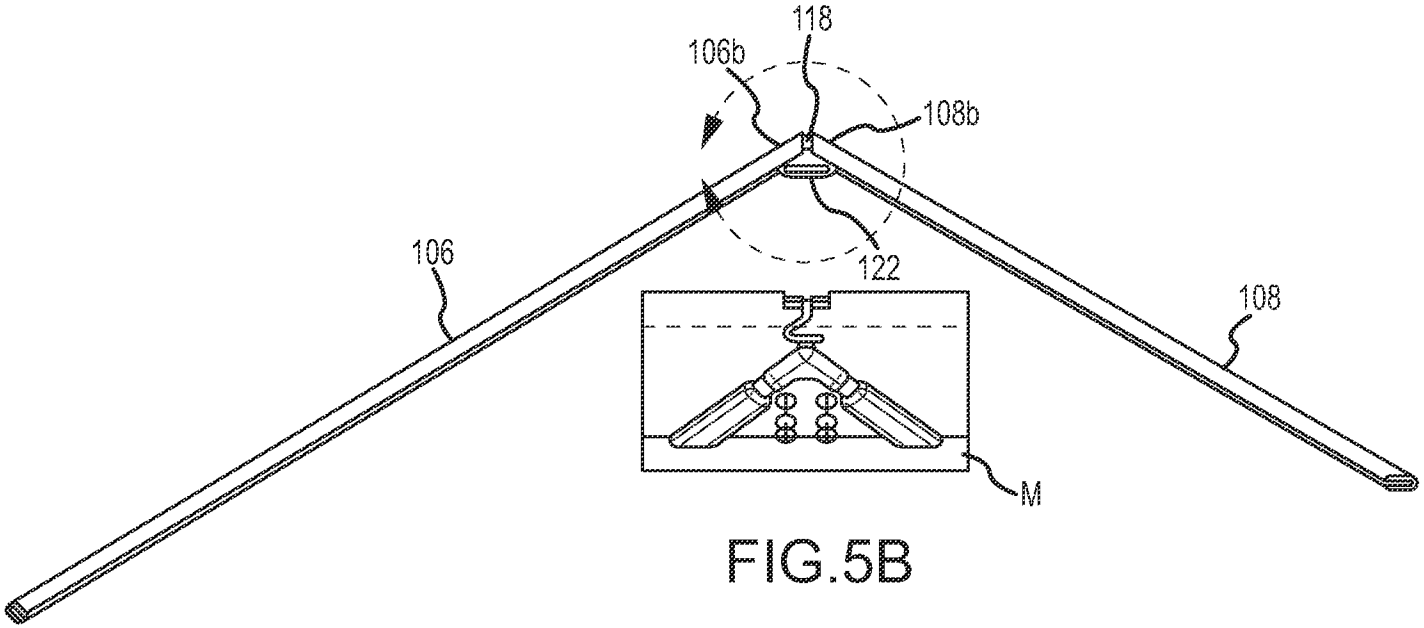

FIG. 4 depicts a method of manufacturing 400 an edge protector. The method 400 includes inserting a retention plate 122 into a slot of a plug 118 (Step 402). The retention plate 122 is then inserted into a slit 106*a* of a side edge strip 106, proximate the beveled end 106*b* thereof (Step 404). Next, the retention plate 122 is inserted into the slit 108*a* of a bottom edge strip 108, proximate the beveled end 108*b* thereof (Step 406). These second two steps are also depicted in FIG. 5A, which does not depict the plug 118. Since the manufacturing steps prior to overmolding may be performed in any order, FIG. 5A depicts the condition where a gap G is maintained between the two beveled ends 106*b*, 108*b*, so as to provide space for subsequent insertion of the plug 118. As depicted in FIG. 5B, the plug 118 is located in the gap G. Of course, the retention plate 122 may first be inserted into the bottom edge strip 108, then the side edge strip 106. Regardless of the order of insertion of the retainer plate 122 into the various elements, the beveled ends 106*b*, 108*b* are placed in abutting contact with the projection (Step 408). The abutting contact between the plug 118 and the beveled ends 106*b*, 108*b* helps ensure a square corner.

Figure 5C:
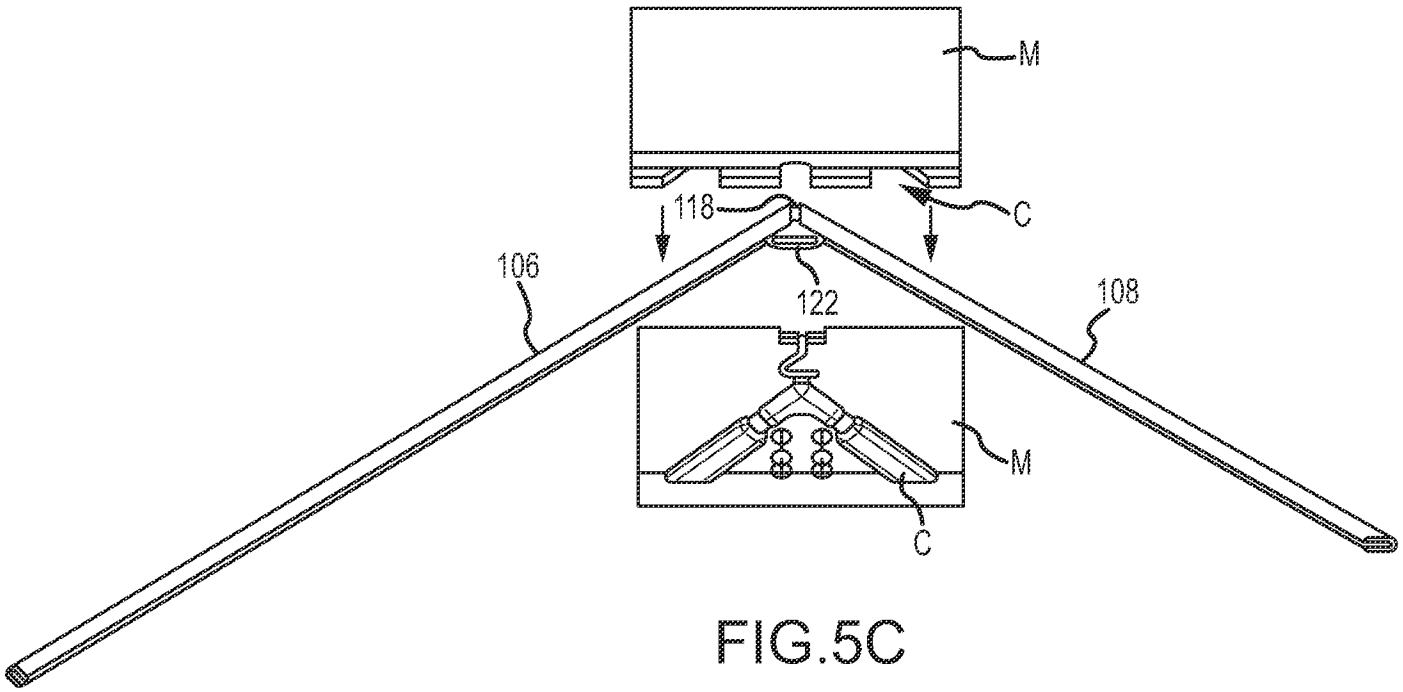
Figure 5D:
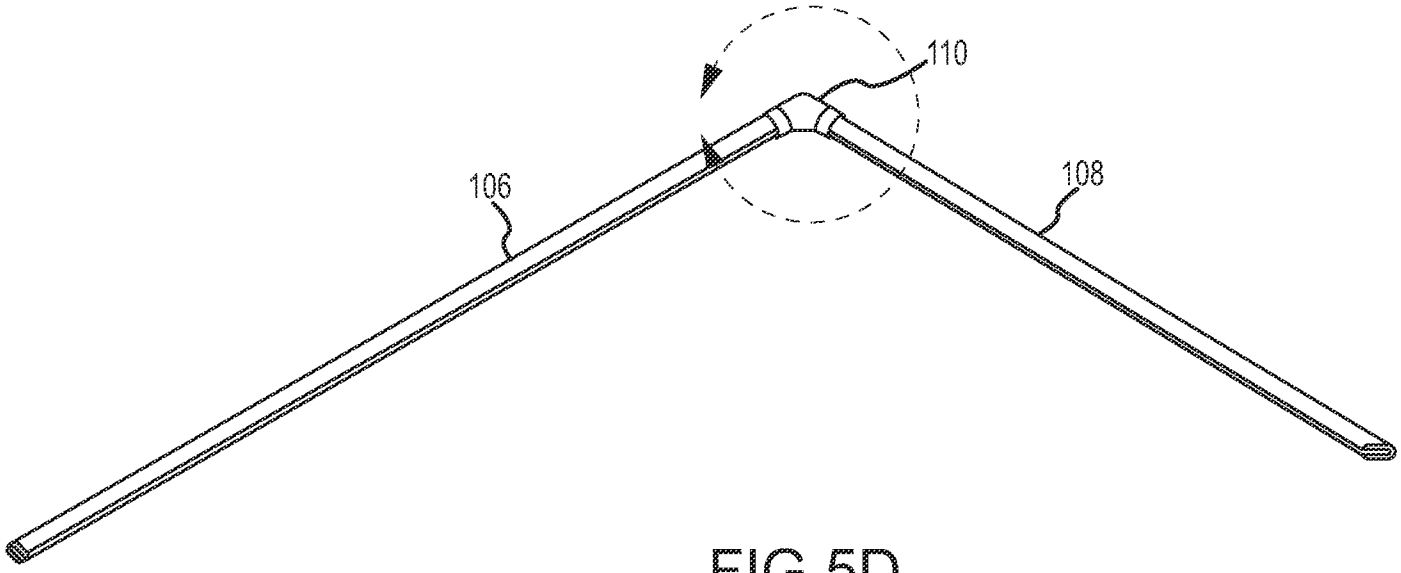

Thereafter, the edge strip assembly may be inserted into a mold M. FIG. 5C depicts a mold M covering the edge strip assembly. The mold M includes upper and lower plates that each define a number of channels C for receipt of the edge strip assembly. The edge strip assembly is placed in the mold M (Step 410), and molten plastic is injected into the mold M, so as to overmold a corner cap 110 on the assembly (Step 412). The plastic may be injected under both high and low pressure processes that are known in the art. Once the plastic has sufficiently cooled, the finished assembly is removed from the mold M (Step 414), and the retention plate 122 is removed (Step 416) to produce the finished edge strip assembly depicted in FIG. 5D. Thereafter, these steps are repeated (Step 418), for the opposite beveled end of the bottom edge strip 108 and the second side edge strip 106 (which may be referred to as the "third" edge strip). Of course, both overmolded caps 110 may be formed at the same time, in multiple molds or a single mold. The finished edge protector may then be inserted onto the edges of a steel plate.

The edge strips 106, 108 may be manufactured of extruded rubber, plastic, or other non-conductive material. Additionally, it is advantageous if the edge protector described herein is manufactured of heat-resistant material, since the edge protectors are often cleaned by exposure to high heat fluids. Exemplary materials for both the bottom and side edge strips may include ABS, polypropylene, HDPE, LDPE, PVC, CPVC, thermoplastics, composite polymers, etc. In other embodiments, the bottom edge strip may be manufactured of CPVC and the side edge strips may be manufactured of PVC. The plug may be manufactured of robust non-conductive plastics, as may the retention plate. Additionally, the retention plate may be manufactured of metal such as steel, stainless steel, or titanium, such that the plate may be re-used over a long period of time. The plastics used in the overmolding process may include ABS, polypropylene, HDPE, LDPE, PVC, CPVC, thermoplastics, composite polymers, etc. Other types and combinations of materials for the various components are contemplated.

While there have been described herein what are to be considered exemplary and preferred embodiments of the present technology, other modifications of the technology will become apparent to those skilled in the art from the teachings herein. The particular methods of manufacture and geometries disclosed herein are exemplary in nature and are not to be considered limiting. It is therefore desired to be secured in the appended claims all such modifications as fall within the spirit and scope of the technology. Accordingly, what is desired to be secured by Letters Patent is the technology as defined and differentiated in the following claims, and all equivalents.

What is claimed is:

1. An edge protector for a cathode plate, the edge protector comprising:

a first side edge strip comprising a beveled end and an elongate slit;

a second side edge strip comprising a beveled end and an elongate slit;

a third bottom edge strip comprising first and second beveled ends and an elongate slit;

a first plug abutting both of the beveled end of the first side edge strip and the first beveled end of the of the third bottom edge strip;

a second plug abutting both the beveled end of the second side edge strip and the second beveled end of the third bottom edge strip;

wherein the plugs each have a slot alignable with the slits and creating a gap between the beveled edges; and first and second overmolded corner caps covering the beveled ends and the gaps.

2. The edge protector of claim 1, further comprising a first removable retention plate insertable into the elongate slits of the first, second and third edge strips, and the slots of the first and second plugs for overmolding the caps covering the beveled ends and the gaps with a nonconductive polymer plastic without filling the edge srips' slits and the plugs' slots with the plastic.

3. A cathode plate comprising the edge protector of claim 1 with the cathode plate fitting into the slits and slots.

4. The edge protector of claim 1 wherein the edge strips and plugs are made of nonconductive polymer plastics.

5. The edge protector of claim 1 wherein the plugs are each of a smaller dimension than the edge strips creating the gap between the edge strips as the plugs abut the edge strips.

6. The edge protector of claim 1 wherein the edge strips are C-shaped.

7. The edge protector of the claim 1 wherein the first and second overmolded corner caps covering the beveled ends and the gaps also cover a portion of the edge strips.

8. An edge protector for a cathode plate, the edge protector comprising:

a first side edge strip comprising a beveled end and an elongate slit;

a second side edge strip comprising a beveled end and an elongate slit;

a third bottom edge strip comprising first and second beveled ends and an elongate slit;

a first plug of a smaller dimension than the edge strips abutting both of the beveled end of the first side edge strip and the first beveled end of the third bottom edge strip;

a second plug of a smaller dimension than the edge strips abutting both the beveled end of the second side edge strip and the second beveled end of the third bottom edge strip;

wherein the plugs each have a slot alignable with the slits and creating a gap between the beveled edges; and first and second overmolded corner caps covering the beveled ends, the gaps and a portion of the edge strips.

9. The edge protector of claim 7 wherein the edge strips and plugs are made of nonconductive polymer plastics.

10. The edge protector of claim 8, further comprising a removable retention plates insertable into a portion of the elongate slits of the first, second and third edge strips and the slots of the first and second plugs for overmolding the caps covering the beveled ends and the gaps with a nonconductive polymer plastic without filling the edge strips' slits and the plugs' slots with the plastic.

11. An edge protector of nonconductive polymer plastic material for a cathode plate, the edge protector comprising:

a first side edge strip comprising a beveled end and an elongate slit;

a second side edge strip comprising a beveled end and an elongate slit;

a third bottom edge strip comprising first and second beveled ends and an elongate slit;

a first plug of a smaller dimension than the edge strips abutting both of the beveled end of the first side edge strip and the first beveled end of the third bottom edge strip;

a second plug of a smaller dimension than the edge strips abutting both the beveled end of the second side edge strip and the second beveled end of the third bottom edge strip;

wherein the plugs each have a slot alignable with the slits and creating a gap between the beveled edges;

first and second overmolded corner caps covering the beveled ends, the gaps and a portion of the edge strips; and a removable retention plate insertable into a portion of the elongate slits of the first, second and third edge strips and the slots of the first and second plugs for overmolding the caps covering the beleved ends and the gaps with a non-conductive plastic without filling the edge strips' slits and the plugs' slots with the plastic.

* * * * *